US007055609B2

(12) United States Patent
Hayes et al.

(10) Patent No.: US 7,055,609 B2
(45) Date of Patent: Jun. 6, 2006

(54) HANDLING AND ASSEMBLY EQUIPMENT AND METHOD

(75) Inventors: Kevin W. Hayes, Missouri City, TX (US); Craig D. Johnson, Letchworth (GB); Dennis L. Mills, Friendswood, TX (US); Matthew R. Hackworth, Pearland, TX (US); Michael D. Langlais, Houston, TX (US); Martin Prado, Friendswood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 100 days.

(21) Appl. No.: 10/452,894

(22) Filed: Jun. 2, 2003

(65) Prior Publication Data

US 2003/0221842 A1 Dec. 4, 2003

Related U.S. Application Data

(60) Provisional application No. 60/408,279, filed on Sep. 5, 2002, provisional application No. 60/385,272, filed on Jun. 3, 2002.

(51) Int. Cl.
*E21B 19/06* (2006.01)
*B66C 1/66* (2006.01)

(52) U.S. Cl. ..... 166/380; 166/77.52; 166/85.1; 81/57.17; 294/102.2

(58) Field of Classification Search ..... 166/378, 166/380, 77.51–77.53, 85.1; 81/57.16, 57.17; 294/86.29, 102.1, 102.2
See application file for complete search history.

(56) References Cited

U.S. PATENT DOCUMENTS

| | | | | |
|---|---|---|---|---|
| 2,016,683 | A * | 10/1935 | Moore | 294/86.15 |
| 3,463,247 | A * | 8/1969 | Klein | 173/164 |
| 4,295,527 | A * | 10/1981 | Russe | 166/380 |
| 4,809,792 | A * | 3/1989 | Lynch | 175/113 |
| 5,806,589 | A * | 9/1998 | Lang | 166/77.53 |
| 5,865,073 | A * | 2/1999 | Wilson et al. | 81/57.33 |
| 6,095,242 | A * | 8/2000 | Lequang et al. | 166/88.2 |
| 6,138,776 | A * | 10/2000 | Hart et al. | 175/85 |
| 6,213,686 | B1 * | 4/2001 | Baugh | 405/166 |
| 6,220,361 | B1 * | 4/2001 | Brisco | 166/379 |
| 6,244,360 | B1 | 6/2001 | Steinsland | |
| 6,253,844 | B1 * | 7/2001 | Walker | 166/77.51 |
| 6,327,938 | B1 | 12/2001 | Pietras | |
| 6,330,911 | B1 | 12/2001 | Allen et al. | |
| 6,330,918 | B1 * | 12/2001 | Hosie et al. | 166/341 |
| 6,360,633 | B1 | 3/2002 | Pietras | |
| 6,378,614 | B1 * | 4/2002 | Adams et al. | 166/382 |
| 6,527,047 | B1 | 3/2003 | Pietras | |
| 2002/0046840 | A1 | 4/2002 | Schetky et al. | |
| 2002/0092648 | A1 | 7/2002 | Johnson et al. | |
| 2002/0092658 | A1 | 7/2002 | Johnson et al. | |
| 2002/0107562 | A1 | 8/2002 | Hart et al. | |
| 2002/0144822 | A1 | 10/2002 | Hackworth et al. | |

* cited by examiner

*Primary Examiner*—David Bagnell
*Assistant Examiner*—Shane Bomar
(74) *Attorney, Agent, or Firm*—Robert A. Van Someren; Kevin P. McEnaney; Jaime A. Castano

(57) ABSTRACT

A handling and assembly system and method for use in deploying tubing in a subterranean environment. A framework is used to linearly engage sequential tubular members as a tubing string is formed and run into a subterranean environment. The system also facilitates the disassembly of the individual tubular components from the tubing string.

20 Claims, 9 Drawing Sheets

HANDLING AND ASSEMBLY EQUIPMENT AND METHOD

CROSS-REFERENCE TO RELATED APPLICATIONS

The following is based on and claims priority to Provisional Application Ser. No. 60/408,279, filed Sep. 5, 2002 and to Provisional Application Ser. No. 60/385,272, filed Jun. 3, 2002.

BACKGROUND

In a variety of subterranean environments, such as wellbore environments, tubing is deployed in sections that are sequentially connected. For example, sections of production tubing may be threaded together as tubing is continually run into a wellbore. Additionally, tubular members, such as sand screens and other wellbore completion components, are connected as such systems are moved downhole. Some existing tubular members comprise a joint area with a fixed shoulder that rests on plates of a screen table while the next sequential member is connected. However, new component designs, e.g. new sand screen designs, may be made without shoulders and without threaded engagement features. Accordingly, existing handling and assembly equipment may not be adequate for handling such components.

SUMMARY

In general, the present invention provides handling and assembly equipment. Embodiments of the handling and assembly equipment provide for downhole applications using a variety of sand screen as well as other wellbore component configurations.

BRIEF DESCRIPTION OF THE DRAWINGS

Certain exemplary embodiments of the invention will hereafter be described with reference to the accompanying drawings, wherein like referenced numerals denote elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to handling and assembly equipment and related methods. These equipment and methods are useful with, for example, tubulars fitted with bayonet-type connectors. However, the equipment and methods of the present invention are not limited to use with those specific type connectors and corresponding tubulars. The present invention may be used with other tubulars and other types of equipment. For example, the present invention may be useful with sand screens, well equipment having stab-in type connections, expandable tubing, expandable sand screens and other well equipment components and connections.

Figure 1:
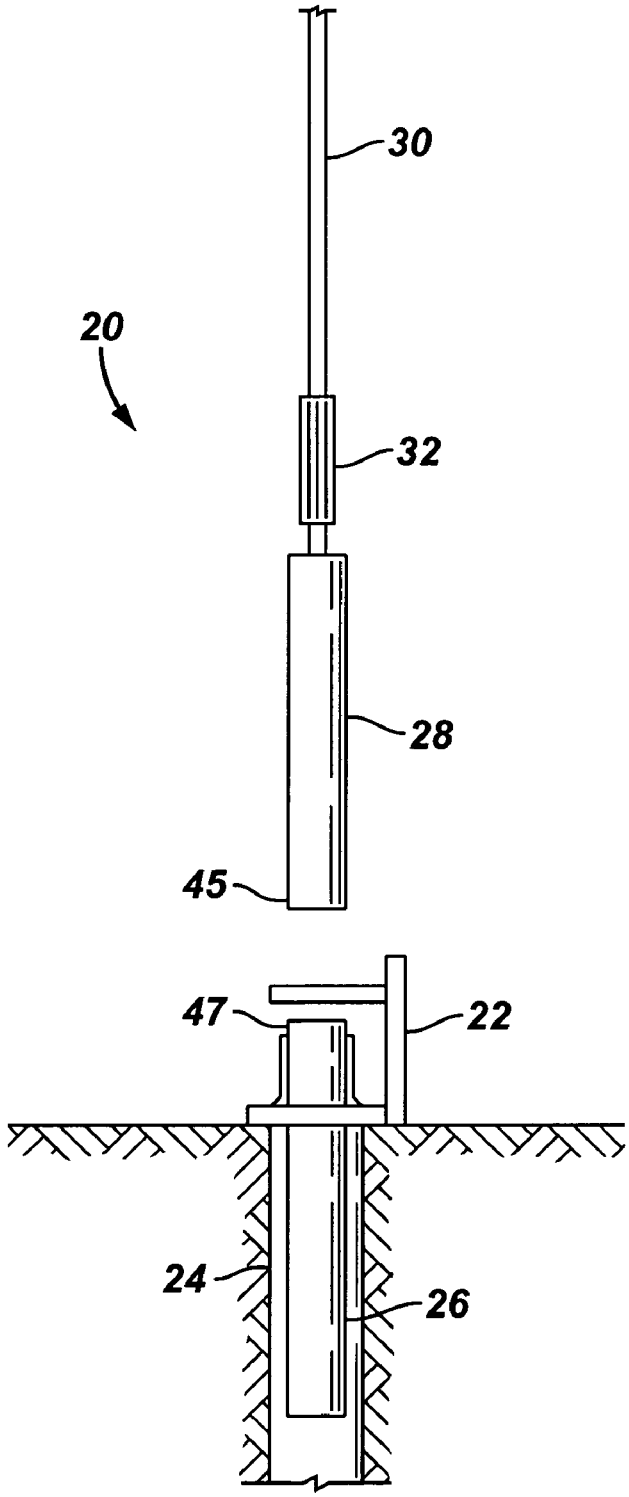
FIG. 1 is a schematic illustration of a handling and assembling system, according to an embodiment of the present invention.

Referring generally to FIG. 1, a system 20 is illustrated according to an embodiment of the present invention. The system 20 comprises an assembly tool 22 to facilitate the sequential assembly of tubular components that are deployed in, for example, a wellbore 24. For example, a tubular component 26, such as a sand screen, may be held by assembly tool 22 while another tubular member 28, e.g. production tubing or sand screen section, is connected to sand screen 26. Tubular members 26 and 28 are described to aid in the description of system 20, however a variety of other types of downhole components can be utilized in the system.

The upper tubular member 28 is brought into proximity with lower tubular member 26 to enable coupling of the tubular members via assembly tool 22. Tubular member 28 may be moved towards assembly tool 22 and tubular member 26 by a lifting elevator 30, such as the type utilized with a rig. Lifting elevator 30 may be connected to tubular member 28 through a damper unit 32 that aids in the connection of tubing members as well as the loading and unloading of the tubing string as sequential tubular members are added to the string.

Figure 2:
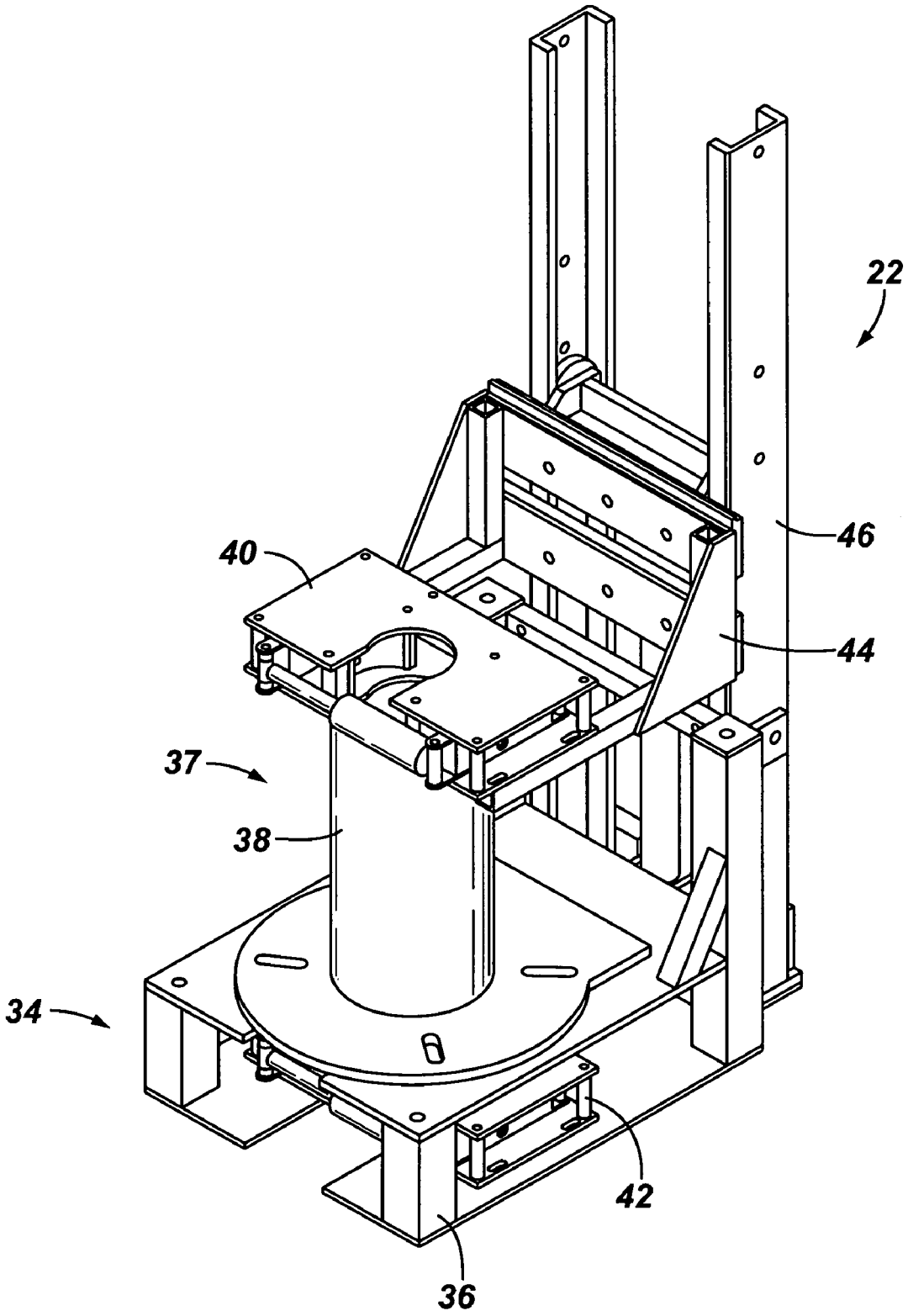
FIG. 2 is an isometric view of an assembly press according to one embodiment of the invention.

In FIG. 2, an embodiment of assembly tool 22 is illustrated. In this embodiment, assembly tool 22 comprises an assembly press 34 having a frame 36, a securing system 37, such as a spider 38, an upper clamp 40, a lower clamp 42 and a linear actuator 44, such as a moving platform. Frame 36 comprises a linear guide 46 along which platform 44 moves in a linear, e.g. vertical, direction. Spider 38 is used to hang the tubular members, e.g. sand screen 26, at the rig floor surface during assembly of subsequent tubular members.

Although spider 38 is illustrated for hanging the string at the rig floor surface during assembly of tubular components, other devices, such as screen table plates, can be utilized as described in greater detail below. Examples of spiders that can be used in assembly tool 22 are commercially available spiders, such as the CAVINS 'Advance' spider available from Cavins Oil Well Tools of Long Beach, Calif., U.S.A. and illustrated at the Cavins website http://www.cavins.com/. The spider has hydraulically activated slips for holding tubular members at the rig floor. Such spiders come in a variety of sizes for various diameter pipes and other tubular members. It also should be noted that the handling of tubular members by spider 38 can be enhanced with the use of slip liners designed for "non-marking" applications, such as slip liners available from Cheyenne Services, Inc. of Houston, Tex. The slip liners provide smooth slip inserts able to hold the tubing string in the spider slips without substantial marking of the tubular members.

During assembly of a tubular string, assembly tool 22 is used to hold the string, e.g. an expandable screen string, at the surface while assembling or disassembling connections. For assembly, the first tubular member 26 is lowered into the spider 38 and the slips are closed to hang the tubular member 26, e.g. a sand screen section. The next tubular member 28 is then lowered into place over member 26, as illustrated in FIG. 1, such that the ends of the tubular members are aligned. The moving platform 44 with upper clamp 40 is then moved towards tubular member 28 until upper clamp 40 may be closed on tubular member 28. Platform 44 is then moved downwardly until a lower end 45 of tubular member 28 is snapped or otherwise joined to an upper end 47 of tubular member 26 (see FIG. 1). Following completion of the assembly, the upper clamp 40 is opened followed by release of spider 38 such that the tubing string may be run-in-hole until positioned for the next joint assembly. This process is continued until the screen string or other tubular string is completely assembled.

For disassembly, the connection to be disconnected is moved into position below upper clamp 40 and securing system 37, e.g. spider 38, is set. Then, upper clamp 40 is clamped to the upper tubular member while lower clamp 42 is clamped to the lower tubular member. Actuating platform 44 moves upper clamp 40 upwardly along linear guide 46 to linearly disconnect the tubular members. The remaining tubing string is once again lifted to enable disconnection of the next joint, and this process is continued until the desired state of disassembly is achieved.

In the embodiment illustrated, moving platform 44 is hydraulically actuated. However, platform 44 may be moved by a variety of other actuators, such as pneumatic actuators, ball screws and other mechanisms.

Figure 3:
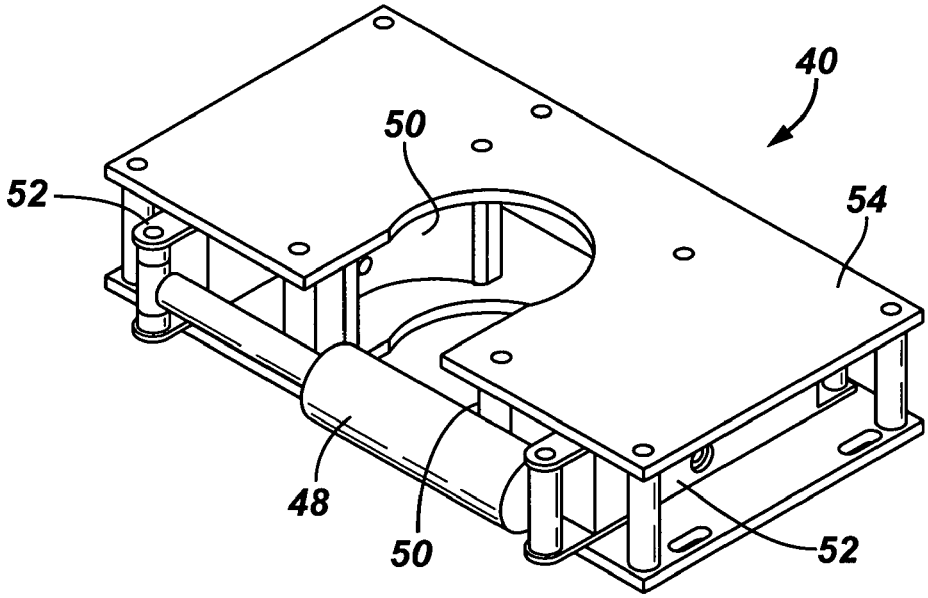
FIG. 3 is an isometric view of an embodiment of an upper or lower clamp illustrated in FIG. 1.

An embodiment of upper and lower clamps 40, 42 is illustrated in FIG. 3. In this embodiment, each clamp 40, 42 utilizes at least one hydraulic cylinder 48, e.g. two hydraulic cylinders 48, coupled to at least two C-shaped clamp faces 50 via linkage mechanisms 52. Linkage mechanisms 52 are slideably or pivotably mounted within a clamp framework 54 to move C-shaped clamp faces towards and away from each other upon actuation via hydraulic cylinder 48. The C-shaped clamps are designed to hold with enough force for the assembly and/or disassembly of the tubing string joints. The linear guide 46 maintains the upper clamp 40 and lower clamp 42 in general alignment.

Figure 4:
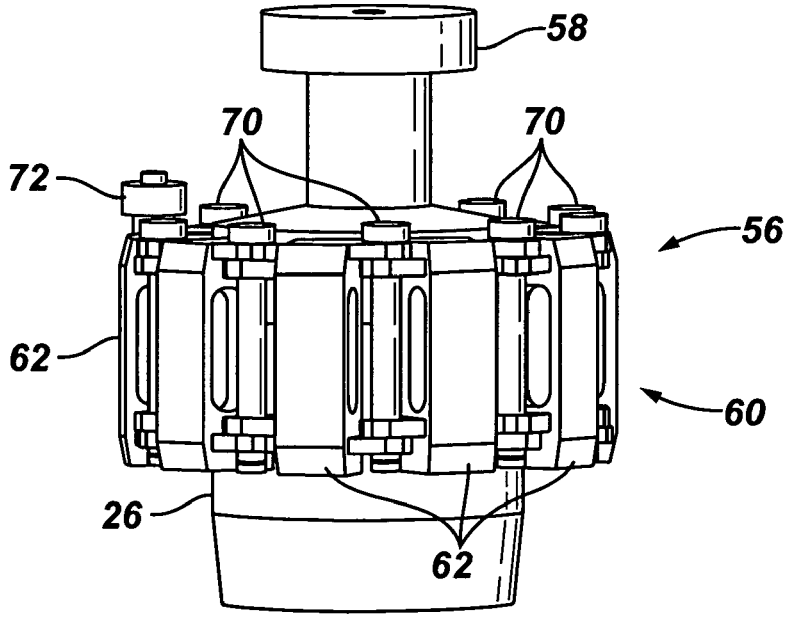
FIG. 4 is an isometric view of a lifting wrap according to an embodiment of the present invention.
Figure 5:
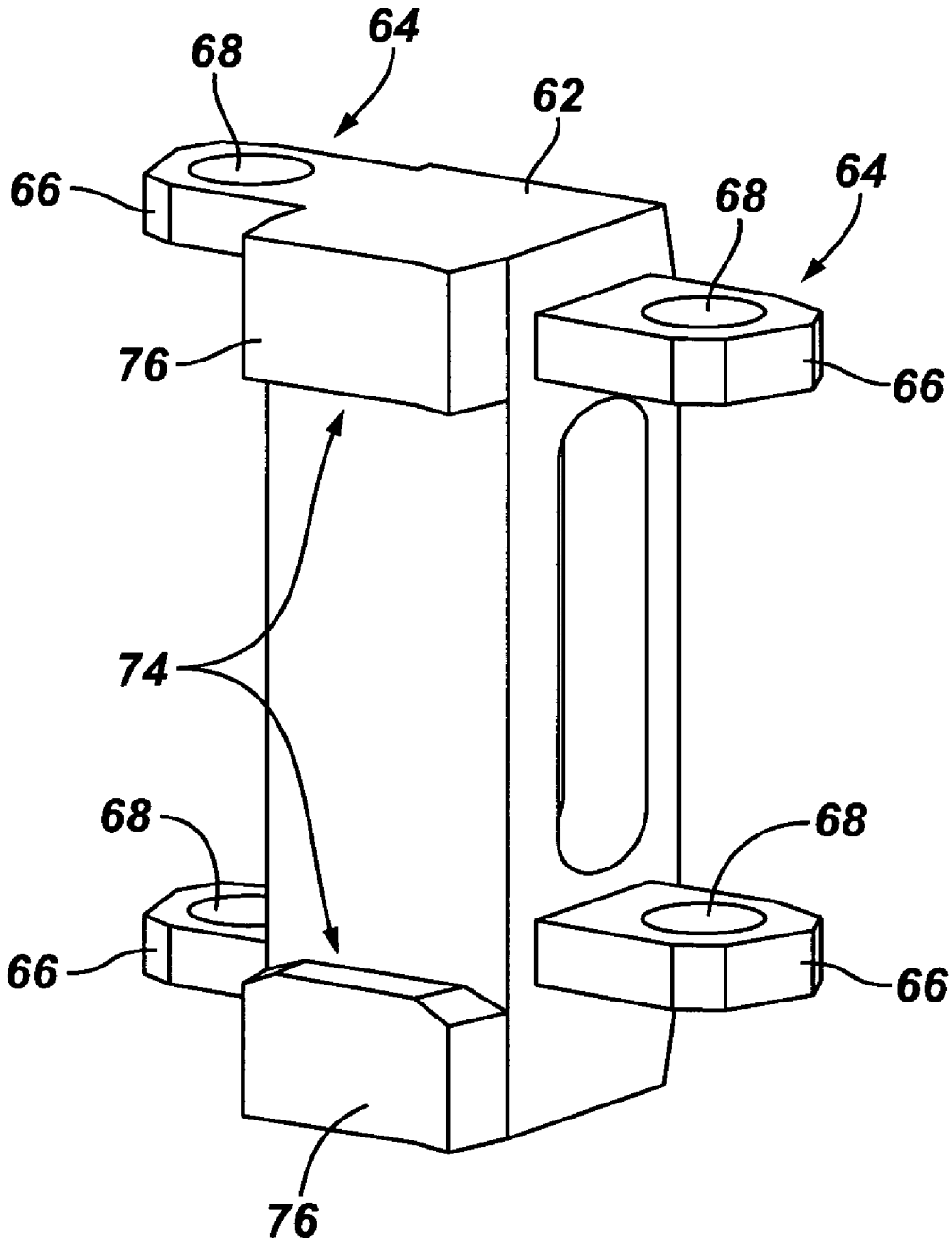
FIG. 5 is an isometric view of an embodiment of a wrap key used with the lifting wrap illustrated in FIG. 4.
Figure 6:
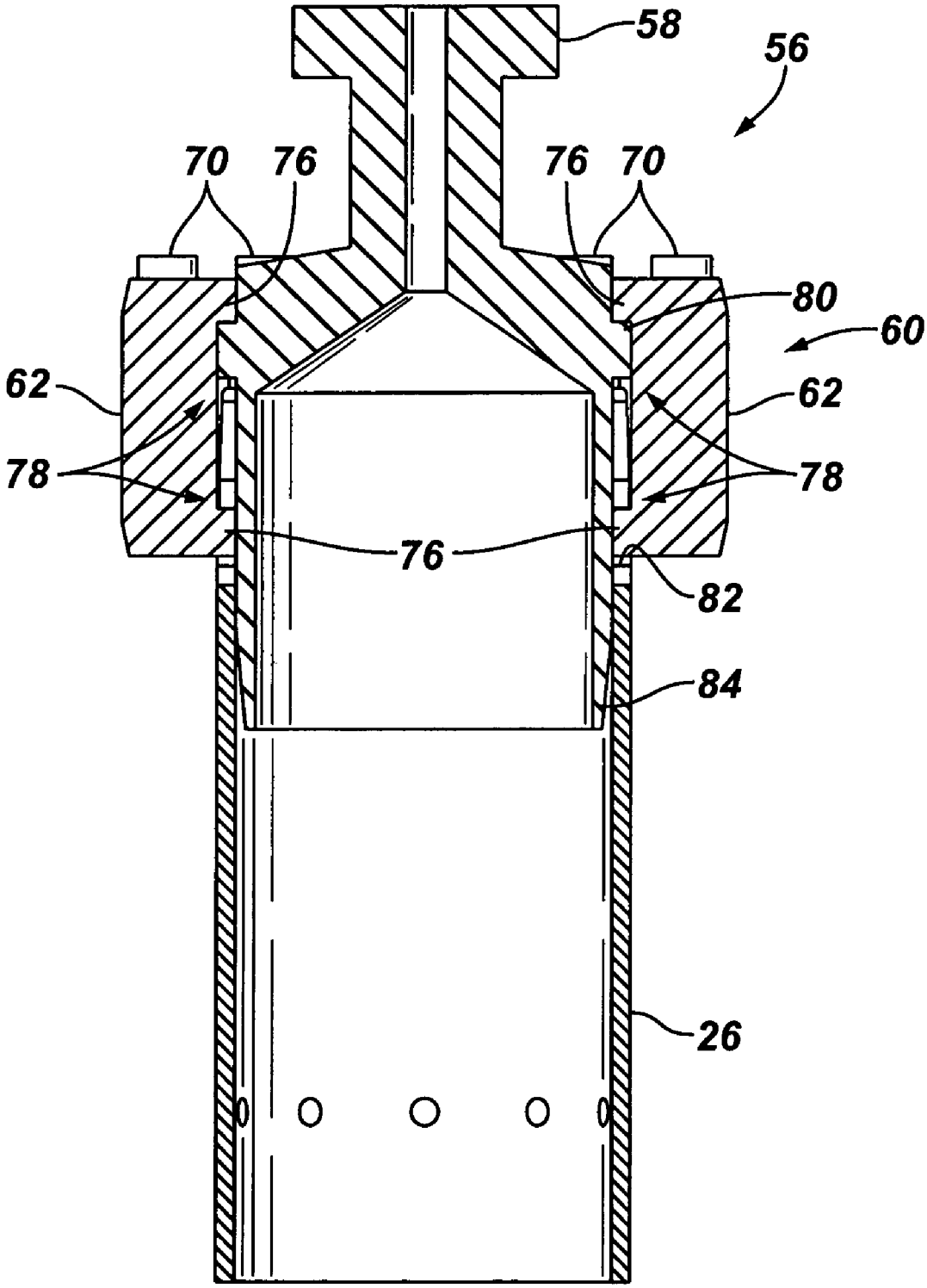
FIG. 6 is generally an axial cross-sectional view illustrating the lifting wrap of FIG. 4 combined with a sand screen.

Referring generally to FIGS. 4–6, a lifting mechanism 56 for moving tubular members, such as a tubular sand screen, is illustrated. Lifting mechanism 56 is designed to selectively couple a tubular member, e.g. tubular member 26 or 28, to an appropriate deployment system, such as a lifting elevator 30 or the combined lifting elevator 30 and damper unit 32. In the embodiment illustrated in FIGS. 4–6, lifting mechanism 56 comprises a mandrel 58 and a lifting wrap 60 for selectively coupling mandrel 58 to a tubular member, such as tubular member 26. In this embodiment, mandrel 58 may be connected to damper unit 32 either directly or by an appropriate connector or coupling. The mandrel 58 and lifting wrap 60 may be used to securely grab the end of a tubular member to lift the member in and out of wellbore 24. As illustrated in FIGS. 4 and 5, an embodiment of lifting mechanism 56 comprises a plurality of lifting keys 62. Each lifting key 62 comprises at least a pair of pivot features 64 that may have tabs 66 with openings 68 for receiving pivot pins 70. Thus, each lifting key 62 may be pivoted with respect to the adjacent lifting keys to which it is pivotably attached via pivot pins 70. Lifting wrap 60 is wrapped around a tubular member and connected by a final connector pin 72, as illustrated in FIG. 4.

In the embodiment illustrated, each lifting key 62 also comprises an engagement feature 74 able to engage both mandrel 58 and a selected tubing component, such as sand screen 26. As illustrated in FIG. 5, engagement feature 74 may comprise a pair of extensions 76 configured to engage corresponding features 78 of mandrel 58 and tubular member 26. In this embodiment, corresponding features 78 comprise a mandrel shoulder 80 extending radially upward from mandrel 58 and an opening or recess 82 formed in the sidewall of tubular member 26.

To connect lifting mechanism 56 to tubular member 26, a lead end 84 of mandrel 58 is inserted into the interior of tubular member 26 until the upper extent of tubular member 26 is adjacent a lower end of mandrel shoulder 80. The lifting wrap 60 is then wrapped around mandrel 58 and tubing member 26, such that the lower extensions 76 of each lifting key 62 engage corresponding openings 82 formed in tubular member 26. Simultaneously, each upper extension 76 of lifting key 62 is engaged with mandrel 58 above shoulder 80 to affectively secure mandrel 58 to the upper end of tubular member 26. Upon insertion of the final connector pin 72, the tubular member 26 may be lifted and moved via mandrel 58. For example, tubular member 26 may be moved into position for connection to the next adjacent tubular member. Mandrel 58 may be released from tubular member 26 by releasing and unwrapping lifting wrap 60. Similarly, mandrel 58 and lifting wrap 60 may be coupled to a tubular that is to be disconnected and lifted away from an adjacent tubular.

Figure 7:
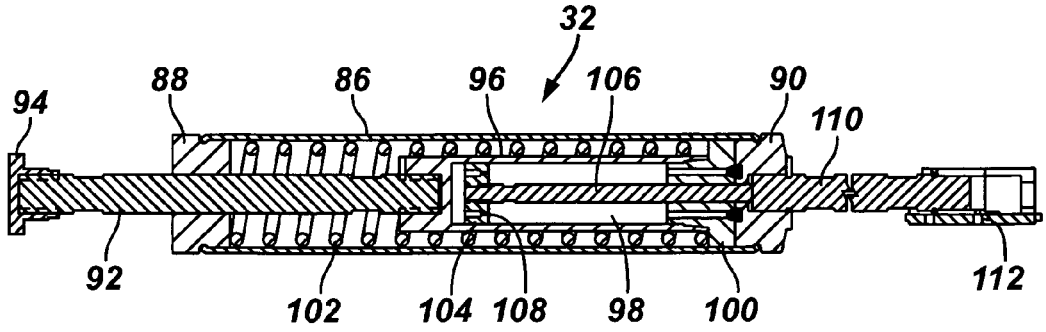
FIG. 7 is a cross-sectional view of an embodiment of an upper sub assembly taken generally along its axis.
Figure 8:
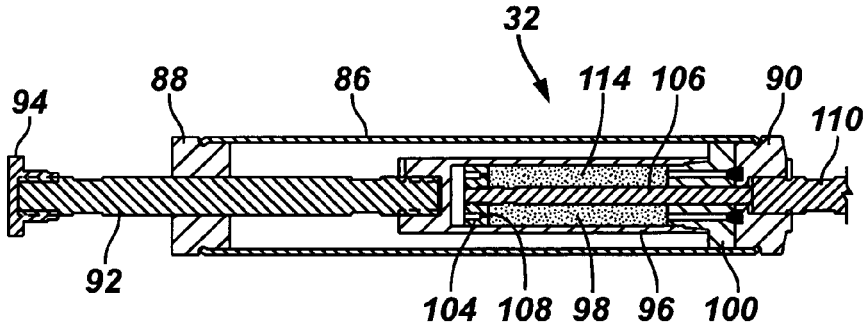
FIG. 8 is a cross-sectional view similar to FIG. 7.
Figure 9:
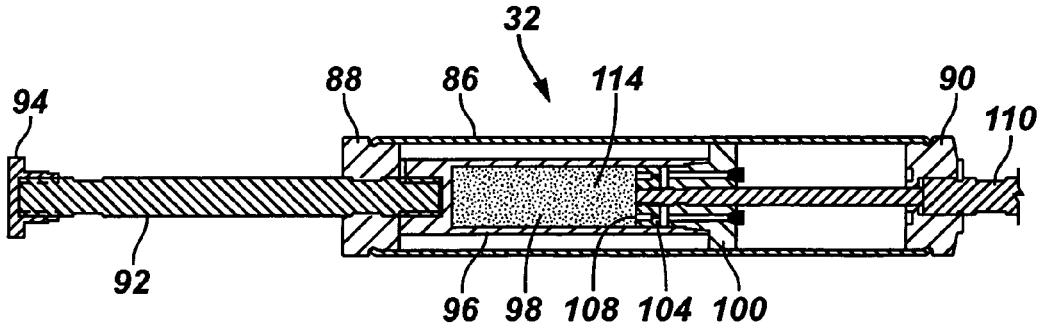
FIG. 9 is another cross sectional view similar to FIG. 7.

Mandrel 58 may be connected to or formed as part of damper unit 32 which serves as an upper subassembly to accommodate movement of the tubular members during assembly. As illustrated in FIGS. 7–9, an embodiment of damper unit 32 enables the movement of the upper screen 28 towards lower screen 26. The damper unit contains a mechanism to absorb the movement of the upper tubular member during assembly and to dampen movement upon release from the tubing string.

As illustrated in FIG. 7, damper unit 32 comprises an external housing 86 coupled to a pair of end caps 88, 90. A shaft 92 is slideably mounted through end cap 88 and comprises a connector end 94 appropriately designed for connection with lifting elevator 30. Opposite connector end 94, shaft 92 is coupled to a piston 96. Piston 96 has a generally hollow interior 98 and a distal flange 100. A spring 102, such as a coil spring, is disposed within external housing 86 between end cap 88 and distal flange 100 to bias piston 96 towards end cap 90.

Within hollow interior 98, a damper piston 104 is slideably positioned and coupled to end cap 90 by, for example, a shaft 106. Damper piston 104 comprises a flow control system 108. Additionally, damper unit 32 comprises an extension 110 that is coupled to end cap 90 and extends from end cap 90 to a connector end 112 designed to engage and lift the appropriate tubular members. For example, connector end 112 may be designed to latch to mandrel 58.

Referring specifically to FIGS. 8 and 9, operation of damper unit 32 can be further described. It should be noted that in FIGS. 8 and 9, the damper unit has been illustrated without spring 102. In FIG. 8, damper unit 32 is shown in an unloaded state. As the string load is applied to damper unit 32 at connector end 112, spring 102 is compressed, and the compression continues with the downforce of the overall tooling increasing until piston 96 abuts against end cap 88, as illustrated best in FIG. 9. The additional string load is carried through the shouldering interface between end cap 88 and piston 96. Furthermore, as piston 96 moves from the unloaded state, illustrated in FIG. 8, to the loaded state, illustrated in FIG. 9, damper piston 104 translates through the hollow interior 98 of piston 96. During this translation, a hydraulic fluid 114 within hollow interior 98 passes through flow control system 108 of damper piston 104 to an opposite side of damper piston 104, as illustrated in FIG. 9. Flow control system 108 is designed to permit relatively easy oil flow through damper piston 104 during loading of the tool and substantially more restricted flow upon unloading of damper unit 32. For example, flow control system 108 may be designed such that as loading occurs, hydraulic oil moves valve plates to expose large holes for easy flow between chambers, i.e. from the right side of damper piston 104 (FIG. 8) to the left side of damper piston 104 (FIG. 9). When damper unit 32 is unloaded, however, the oil pushes the valve plates closed to cover the large holes. Small orifice holes formed either through the valve plates or other parts of damper piston 104 restrict the flow as damper unit 32 transitions from the loaded to the unloaded state. Thus, the energy is allowed to dissipate slowly and in a controlled manner during release of the damper unit or failure of a system component.

Figure 10:
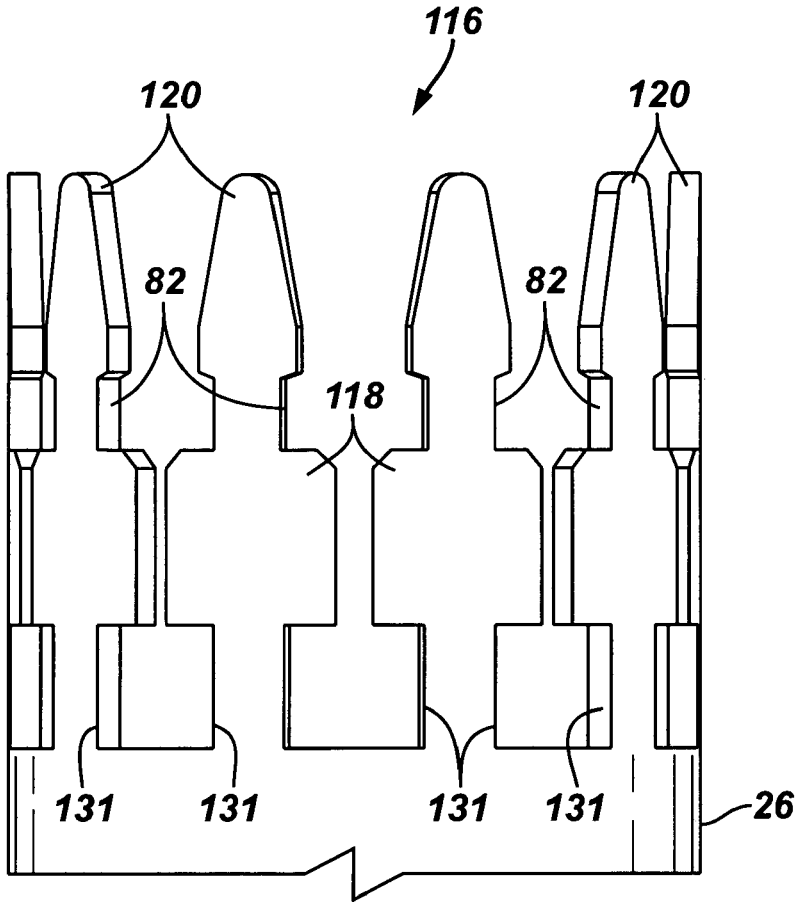
FIG. 10 is a front view of an embodiment of a screen having a hanging wrap profile.

System 20 is amenable to the relatively rapid assembly and disassembly of tubular members that have linear type connectors, such as connectors that stab into one another to form a connection. Although a wide variety of configurations, orientations, sizes and profiles can be used to form such linear connectors, an example is illustrated in FIG. 10. In this design, the tubular member 26 comprises a linear connector end 116, such as a stab-in connector. Linear connector end 116 is designed to linearly engage a similar, corresponding connector end disposed on the next adjacent tubular member, e.g. tubular member 28, to form a tubing string joint as the tubing members are linearly engaged. In this embodiment, tubular member 26 does not have a permanent shoulder, but instead has a plurality of fingers 118. Each finger 118 includes a stab-in connector head 120 designed to linearly engage corresponding connector heads 120 on the next sequential tubular member. Additionally, linear connector end 116 comprises openings 82, as described above with reference to FIG. 6. Openings 82 are sized to receive extensions 76 of lifting keys 62 when lifting wrap 60 is wrapped around tubular member 26 and mandrel 58.

Figure 11:
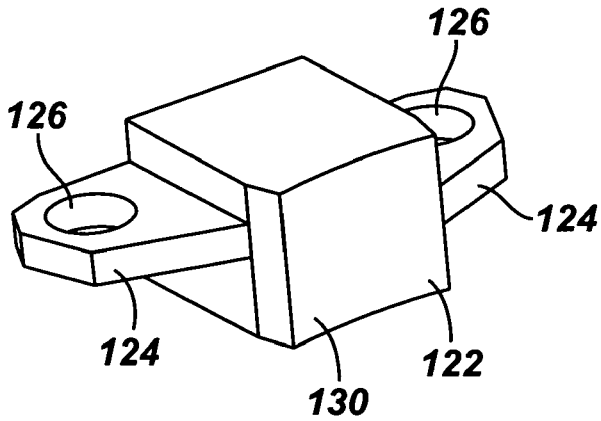
FIG. 11 is an isometric view of an embodiment of a shoulder key for use with a shoulder wrap.
Figure 12:
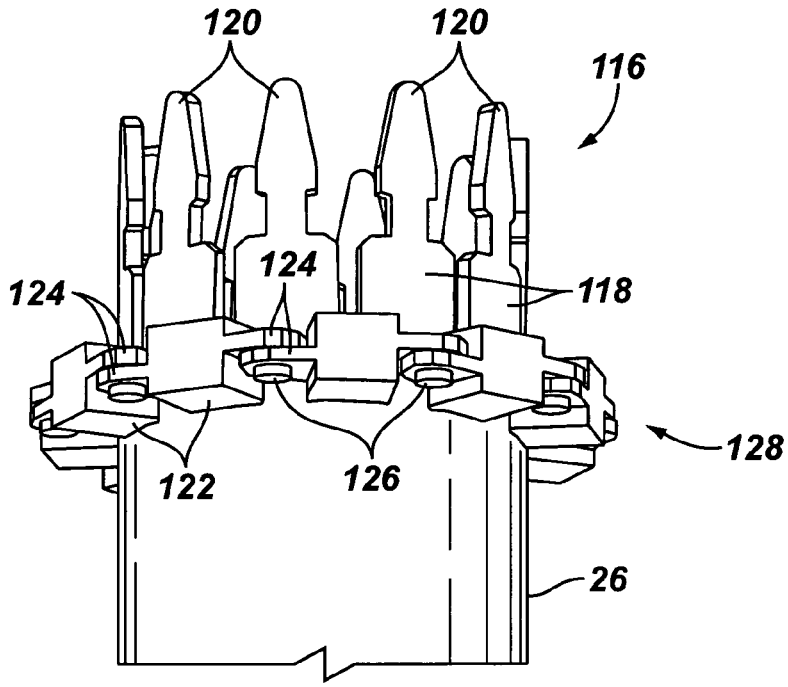
FIG. 12 is an isometric view of another embodiment of a shoulder wrap.

Alternatively, a different embodiment of lifting wrap 60 can be used in conjunction with linear connector ends 116 of tubular members, such as tubular members 26 and 28. In this embodiment, a plurality of shoulder keys 122 (see FIG. 11) are pivotably connected as illustrated in FIG. 12. For example, each shoulder key 122 may comprise a pair of opposed flanges 124 that are pivotably connected to one another via, for example, openings 126 and corresponding pivot pins. The plurality of pivotably connected shoulders keys 122 are combined to form a shoulder wrap 128 that securely engages the tubular member, e.g. sand screen 26. In the example illustrated, each shoulder key 122 comprises an engagement feature 130 that enters a corresponding opening 131 when shoulder wrap 128 is wrapped around tubular member 26 and pinned together with a final retention pin, as described with respect to lifting wrap 60.

Figure 13A:
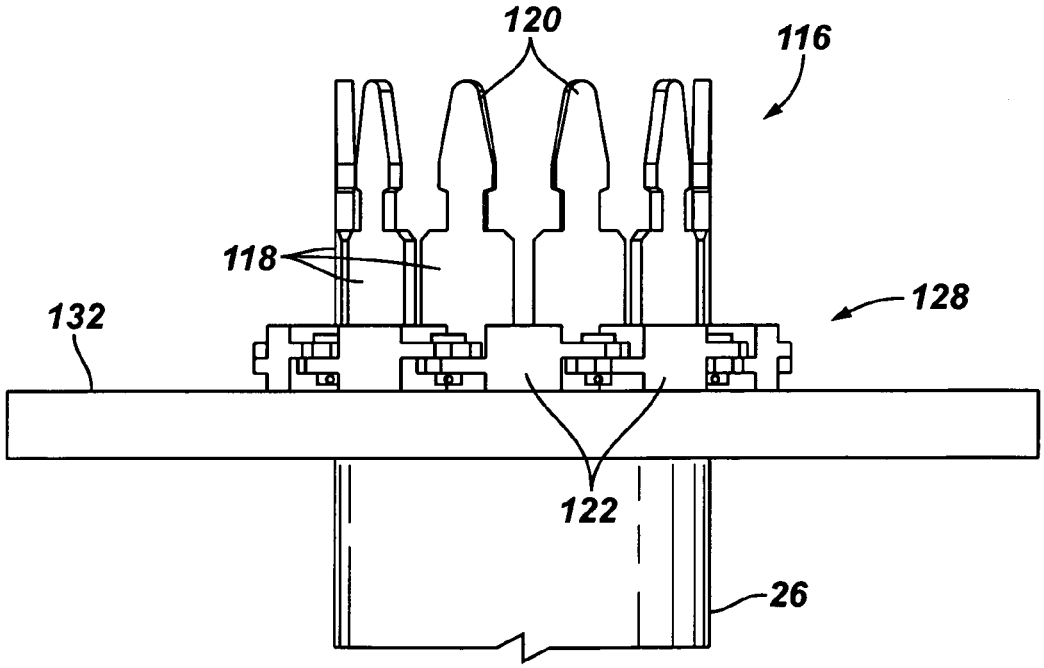
FIG. 13A is a front view of the shoulder wrap and screen illustrated in FIG. 12 disposed on screen table plates.

In this embodiment, shoulder keys 122 are combined into shoulder wrap 128 which creates a removable shoulder that may be selectively attached to each tubular member. The removable shoulder can be utilized with, for example, a hanging plate 132, e.g. a screen table plate, as illustrated in FIG. 13A. The shoulder wrap 128 is coupled to the tubular member, e.g. tubular member 26, and hung from a hanging plate 132. Thus, in some embodiments and applications, spider 38 may be replaced or supplemented by hanging plate 132. Additionally, the shoulder wrap 128 can be used independently with hanging plate 132 or other hanging devices.

Figure 13B:
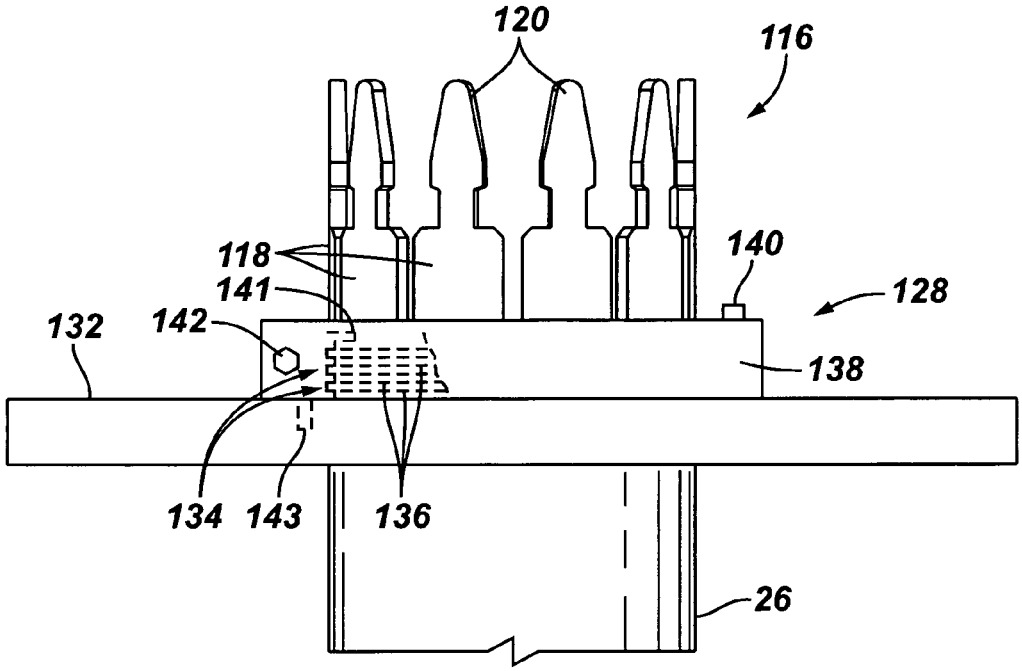
FIG. 13B is a front view similar to FIG. 13A but showing an alternate shoulder wrap.

Another embodiment of a shoulder wrap 128 is illustrated in FIG. 13B. In this embodiment, shoulder wrap 128 is designed for engagement with a tubular member, e.g. tubular member 26, via a profile 134, such as a plurality of grooves and ridges, as illustrated by hidden lines in FIG. 13B. The profile 134 may comprise other features, such as notches, dimples and other types of profiles able to support increased axial loading. In the illustrated embodiment, profile 134 is directed inwardly for engagement with a corresponding profile 136, e.g. grooves and ridges, formed in tubular 26.

Although the profile 134 may be formed in a variety of components, one example utilizes a pair of generally C-shaped collar members 138 pivotably connected via a pivot 140, such as a pivot pin. Thus, collar members 138 may be pivoted between an opened position and a closed position in engagement with corresponding profile 136. A fastener 142, such as a threaded fastener, can be connected between collar members 138 to securely force collar members 138 to a closed position over corresponding grooves and ridges 136. Thus, the weight of tubular member 26 along with any appropriate suspended tubing string can be supported by shoulder wrap 128 on, for example, hanging plate 132. Furthermore, during assembly or disassembly of the tubular members, the shoulder wrap 128 may be selectively disengaged and reengaged with subsequent tubular members.

The shoulder wrap illustrated in FIG. 13B also may comprise an abutment 141, such as a pin, that extends into a corresponding feature of the tubular member or a coupling connected to the tubular member. Abutment 141 prevents relative rotation between collar members 138 and the tubular member. Furthermore, the shoulder wrap may comprise an interfering profile 143 positioned to engage a corresponding feature on hanging plate 132. Profile 143 prevents rotation of the shoulder wrap relative to hanging plate 132 during assembly or disassembly of tubular components. The abutment 141 and profile 143 enable the coupling of a wide variety of tubulars including tubulars that are threaded together. For example, connector end 116 may be replaced with a threaded connector. In one embodiment, a lifting sub connected to lifting elevator 30 is coupled to a tubular via the shoulder wrap and a coupling. The lifting sub and the coupling are connected by a lift sub ring that attaches to the coupling with left handed threads. The left handed threads prevent unthreading/disconnection of the lift sub during connection of tubulars having threaded connector ends.

Figure 14:
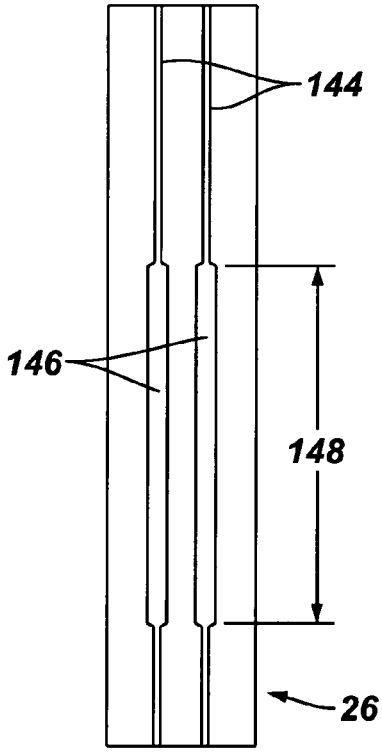
FIG. 14 is a front view of a tubular member having an embodiment of a slip gripping area.
Figure 15:
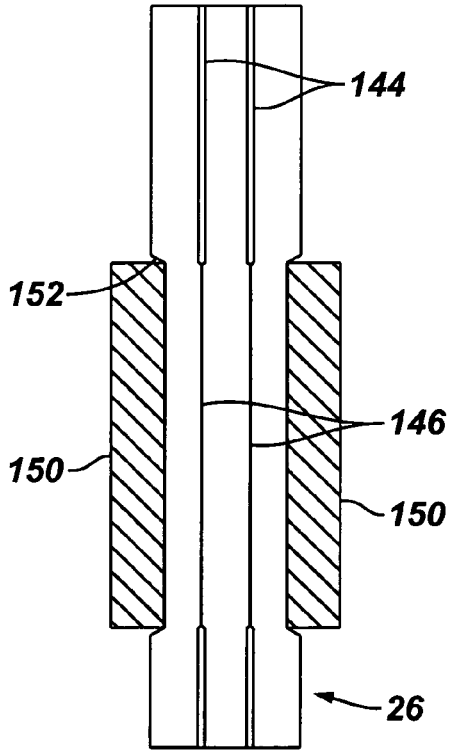
FIG. 15 is a front view of the tubular member illustrated in FIG. 14 with slips applied to the slip gripping area.

In an alternate embodiment, openings 131 are replaced with another type of engagement feature, as illustrated in FIGS. 14 and 15. In this embodiment, a tubular member, such as sand screen 26, comprises a plurality of thin slots that can be arranged in a variety of cell patterns along the tubular member. The thin slots 144 are transitioned to expanded slot regions 146 that form a slip grip area 148. The increased slot width allows the screen 26 to be compressed when squeezed by, for example, a plurality of slips 150, as illustrated in FIG. 15. Slips 150 may be of the type used with spider 38. When slip grip area 148 is squeezed by slips 150, the sand screen is radially compressed to a smaller diameter relative to the unsqueezed tubular portions. The smaller diameter creates a shoulder 152 that rests on an upper edge of slips 150 and provides mechanical holding power. Thus, this type of engagement feature allows each tubular member to be held by assembly tool 22 during coupling with the next sequential tubular member moved linearly into engagement with the hanging member.

Although only a few embodiments of the present invention have been described in detail above, those of ordinary skill in the art or readily appreciate that many modifications are possible without materially departing from the teachings of this invention. Accordingly, such modifications are intended to be included within the scope of this invention as defined in the claims.

What is claimed is:

1. A system for handling tubing utilized in a wellbore, comprising:

a framework;

a securing system to hold a lower tubular member;

an upper clamp to selectively grip an upper tubular member;

a linear actuator connected to the upper clamp, the linear actuator being positioned to move the upper clamp towards or away from the securing system to assemble or disassemble the lower and upper tubular members;

an extensible damper unit, having a spring and a damper system, connected in line with the upper tubular member, the extensible damper unit being sufficiently extensible to absorb full movement of the upper clamp toward the securing system; and a shoulder wrap removably coupled to the lower tubular member by engaging a plurality of recesses found in the lower tubular member, the shoulder wrap being in a position to abut a hanging plate such that the lower tubular member is suspended from the hanging plate.

2. The system as recited in claim 1, wherein the securing system comprises a spider connected to the framework.

3. The system as recited in claim 2, wherein the system comprises a lower clamp connected to the framework at a position to clamp the lower tubular member.

4. The system as recited in claim 1, wherein the securing system comprises a hanging plate.

5. The system as recited in claim 1, wherein the linear actuator comprises a hydraulically actuable platform.

6. A method of handling tubing sections that are assembled through linear movement, comprising:

suspending a first tubing section having an upper connector end;

moving a second tubing section having a lower connector end to a position above the first tubing section;

gripping the second tubing section with a releasable clamp;

interlocking the first tubing section with the second tubing section by linearly moving the releasable clamp and stabbing the lower connector end into the upper connector end; and lifting the second tubing section via a lifting wrap engaging a plurality of openings found in the second tubing section.

7. The method as recited in claim 6, wherein suspending comprises suspending the first tubing section from a spider.

8. The method as recited in claim 6, wherein suspending comprises suspending the first tubing section from a hanging plate.

9. The method as recited in claim 8, further comprising securing a shoulder wrap around the first tubing section in a position to rest against the hanging plate.

10. The method as recited in claim 6, wherein moving comprises moving the second tubing section with a sub assembly having a spring-loaded extensible member coupled to the second tubing section.

11. The method as recited in claim 10, wherein interlocking comprises extending the spring-loaded extensible member by linearly moving the releasable clamp towards the first tubing section.

12. The method as recited in claim 6, further comprising:

clamping the first tubing section; and pulling the second tubing section with the releasable clamp until the lower connector end is separated from the upper connector end.

13. A mechanism for lifting a tubular utilized in a wellbore, comprising:

a mandrel; and a lifting wrap that may be releasably disposed about the mandrel, the lifting wrap having an upper engagement feature to engage the mandrel and a lower engagement feature to releasably engage and lift a tubular, wherein the lifting wrap comprises a plurality of keys pivotably coupled to each other.

14. The mechanism as recited in claim 13, wherein the mandrel comprises a shoulder positioned for engagement with the upper engagement feature.

15. The mechanism as recited in claim 14, wherein the upper engagement feature comprises a plurality of extensions.

16. The mechanism as recited in claim 13, wherein the lower engagement feature comprises a plurality of extensions sized to engage a corresponding plurality of openings in the tubular.

17. The mechanism as recited in claim 16, wherein the lifting wrap comprises a plurality of keys pivotably connected, each key having at least one of the plurality of extensions.

18. A mechanism to support a tubular during assembly or disassembly of a tubing string designed for use in a wellbore, comprising:

a shoulder wrap releasably engagable with a selected tubular in a tubing string, the shoulder wrap having an engagement feature positioned to engage the selected tubular such that the weight of the tubing string may be supported by the shoulder wrap, wherein the shoulder wrap comprises a plurality of keys pivotably coupled to each other, wherein the engagement feature comprises a plurality of extensions sized to engage corresponding openings in the selected tubular.

19. A mechanism to support a tubular during assembly or disassembly of a tubing string designed for use in a wellbore, comprising:

a shoulder wrap releasably engagable with a selected tubular in a tubing string, the shoulder wrap having an engagement feature positioned to engage the selected tubular such that the weight of the tubing string may be supported by the shoulder wrap, wherein the shoulder wrap comprises a plurality of keys pivotably coupled to each other, wherein the engagement feature comprises a plurality of inwardly extending ridges positioned to engage corresponding ridges on the selected tubular.

20. The mechanism as recited in claim 19, wherein the shoulder wrap further comprises an abutment positioned to prevent rotation of the shoulder wrap relative to the selected tubular and a profile positioned to engage a hanging plate.

* * * * *